US006354478B1

(12) United States Patent
Brückel

(10) Patent No.: US 6,354,478 B1
(45) Date of Patent: Mar. 12, 2002

(54) APPARATUS FOR GUILDING AN ENDLESS PAPER WEB

(75) Inventor: Dieter Brückel, Kaufbeuren (DE)

(73) Assignee: Bowe Systec AG, Augsburg (DE)

( * ) Notice: Subject to any disclaimer, the term of this patent is extended or adjusted under 35 U.S.C. 154(b) by 0 days.

(21) Appl. No.: 09/463,250

(22) PCT Filed: Jul. 9, 1998

(86) PCT No.: PCT/EP98/04268

§ 371 Date: Apr. 21, 2000

§ 102(e) Date: Apr. 21, 2000

(87) PCT Pub. No.: WO99/14147

PCT Pub. Date: Mar. 25, 1999

(30) Foreign Application Priority Data

Sep. 12, 1997 (DE) ..... 197 40 222

(51) Int. Cl.[7] ..... B65H 23/34; B65H 20/00; B65H 57/04

(52) U.S. Cl. ..... 226/88; 226/31; 226/180; 226/187; 242/615.1; 242/615.3

(58) Field of Search ..... 226/30, 31, 88, 226/180, 187, 189, 194, 196.1; 242/615.1, 615.3

(56) References Cited

U.S. PATENT DOCUMENTS

| | | | | |
|---|---|---|---|---|
| 2,050,509 A | | 8/1936 | Swift et al. | |
| 2,558,788 A | * | 7/1951 | Sillars | 226/88 X |
| 2,595,325 A | | 5/1952 | Baumgartner | |
| 3,405,883 A | | 10/1968 | Breitmeier et al. | |
| 4,260,116 A | | 4/1981 | Collin | |
| 4,900,172 A | | 2/1990 | Svoboda | |
| 5,213,246 A | | 5/1993 | Crowley | |
| 5,663,510 A | | 9/1997 | Niemann et al. | |
| 5,695,106 A | * | 12/1997 | Bauknecht | 226/30 X |
| 5,779,124 A | * | 7/1998 | Akira | 226/30 X |
| 6,206,263 B1 | * | 3/2001 | Rich et al. | 226/30 |

FOREIGN PATENT DOCUMENTS

| | | | | |
|---|---|---|---|---|
| DE | 951480 | | 10/1956 | |
| EP | 0307125 | | 3/1989 | |
| EP | 0388042 | | 9/1990 | |
| JP | 5186116 A | * | 7/1993 | 226/88 |

* cited by examiner

*Primary Examiner*—Michael R. Mansen
(74) *Attorney, Agent, or Firm*—Michael A. Glenn

(57) ABSTRACT

An apparatus comprising two lateral guide devices guiding the paper web at the longitudinal edges of the endless paper web, and a deflection means is provided. With the aid of the deflector the paper web is deflected at least once from its direction of movement to increase the stiffness of the paper web while the paper web is moving between the lateral guide devices. Because of that, the paper web is prevented from ascending the lateral guide devices and a damage to the paper web is avoided when the paper web comes into lateral contact with the lateral guide device.

13 Claims, 4 Drawing Sheets

APPARATUS FOR GUILDING AN ENDLESS PAPER WEB

FIELD OF THE INVENTION

The present invention relates to an apparatus for guiding an endless paper web and in particular to an apparatus for guiding an endless paper web without making use of perforated edges or transport pins to a subsequent paper processing means.

BACKGROUND OF THE INVENTION AND DESCRIPTION OF THE PRIOR ART

The present invention relates to an apparatus for guiding an endless paper web and in particular to an apparatus for guiding an endless paper web without making use of perforated edges or transport pins to a subsequent paper processing means.

In the prior art various apparatuses for guiding an endless paper web e.g. to a paper processing system are known. For achieving the straightest possible movement of the paper e.g. through a paper cutter or a printer, one method of implementing a paper guide means is the use of so-called traction means in the case of which transport holes punched into the paper web on both sides thereof are engaged by pins for transporting the paper.

One disadvantage of this paper guide means is to be seen in the fact that, for providing the perforated edges, the paper web must first be taken to a ready-to-use manufacturing apparatus by the producer before it can be supplied to the final consumer. In addition, the transport holes are frequently cut off from the lateral edges of the paper web for optical or other reasons in the means used for further processing, and this entails, in turn, an unnecessary consumption of paper and unnecessary waste paper and it necessitates an edge cutting means.

In the case of a further apparatus for guiding an endless paper web known on the prior art, the straight movement of the paper web is achieved by means of web-edge control making use of adjustable guide and transport rolls.

A paper guide means of this kind requires a very complicated technical design with adjustable guide and transport rolls; in addition, it is very complicated to carry out the adjustments for guiding a paper web of the respective type of paper.

In the prior art, an apparatus is additionally known in the case of which a paper guide means, which is described in detail in FIG. 6. Comprises a trough structure 100 with a concave or convex surface 102 and shoulders 104. The shoulders 104 are provided for engagement with opposed edges of a paper web 106. The direct distance 108 between the shoulders 104 on both sides of the trough structure 100 is smaller than a width 110 of the paper web 106 when flat. The trough structure 100 has the effect that the paper web 106 is deformed with regard to its width 110 so that the distance 108 between edges along the longitudinal sides of the paper web 106 in the trough structure 100 is smaller than the width 110 between the edges of the trough structure. When the apparatus is in use, the paper web 106 moves from an entrance end 112 to an exit end 114 through the trough structure 100. The shoulders 104 engage the paper edged so that the paper is help in the trough structure and guided along a straight line.

The paper web 106 moves through the trough structure 100 to a flat surface 116. This flat surface 116 extends from the concave surface 102 (support structure) of the exit end 114 of the trough structure 100 to the straightening plows 118. The flat surface 116 is additionally provided with a central opening 120. The opening 120 has arranged therein the driving roll 122. The driving roll 122 is arranged in the opening 120 in a vertical plane in such a way that an outer rubber surface 124 of the driving roll 122 is located slightly above the flat surface 116. The outer layer 124 of the driving roll 122 engages the lower surface of the paper web 106 as soon as this paper web 106 moves over the flat surface 116 and conveys the paper web 106 by means of the rotation of the driving roll 122.

The straightening plows 118 are provided at the end of the flat surface 116 opposite the trough structure 100, as can be seen in FIG. 6. The straightening plows 118 comprise an upper lip 124 and a lower lip 126. In this arrangement, a pressure roll 128 is used for applying a pressure on a paper web passing between the pressure roll 106 will be maintained in contact with the driving roll 122.

The direction of movement of the paper web 106 through the trough structure 100 is indicated by the arrow 130 in FIG. 6.

Due to the fact that the driving roll 122 is arranged such that it projects through the opening 120 above the flat surface 116, an axial displaceability of the driving roll 122 is not possible.

An apparatus of this type is known e.g. from U.S. Pat. No. 5,213,246, which achieves paper guidance by means of a trough structure in which the paper web flows, the trough structure being formed in one piece. Due to the structural design of this trough structure, a separate trough structure is required for each paper web width. In addition, when the paper web running through the trough structure is very broad and thin, only a very slight increase in the stiffness of the paper web can be reckoned with.

In view of the above-mentioned facts, known paper transport means are only capable of guiding paper webs having a specific width and paper thickness or it is necessary to use either so-called traction means or a complicated web-edge control for guaranteeing that the paper web moves along a straight path e.g. to a paper processing system.

SUMMARY OF THE INVENTION

It is the object of the present invention to provide an apparatus for guiding an endless paper web which is capable of handling the paper web independently of its width and thickness without using any traction means or web-edge control.

The present invention is an apparatus for guiding an endless paper web having:

- two lateral guide devices guiding the paper web at the longitudinal edges thereof;
- a deflector with the aid of which the paper web is deflected at least once from its direction of movement while it is moving between the lateral guide devices; and
- a first transport roll on a drivable shaft and a second transport roll for applying a feed force to the paper web passing between the first and the second transport roll.

The present invention is based on the finding that an increase in the stiffness of the paper web is achieved by vertically deflecting the paper web from the direction of movement, whereby the paper web will be prevented from ascending the lateral guide means and whereby damage to the paper web will be avoided when the paper web comes into lateral contact with the lateral guide means.

An advantage of the present invention is to be seen in the fact that paper costs can be reduced essentially, since the paper webs can be used with an unperforated edge thus avoiding the necessity of laterally cutting off the transport holes for optical or other reasons in the means used for further processing; this avoids an unnecessary consumption of paper and unnecessary waste paper, and additional edge cutting means can be dispensed with.

According to a preferred embodiment of the present invention, a wave-shaped path of movement or rather a wave-shaped deflection of the paper web from its direction of movement is achieved by means of a plurality of round bars between which the paper web passes. Since the deflection of the paper web can be adjusted to different paper web widths, paper thicknesses and strengths by adjusting one of the round bars and the distance of the lateral guide means, the apparatus for guiding an endless paper web is capable of handling paper webs with arbitrary paper web widths, paper thicknesses and strengths, respectively.

BRIEF DESCRIPTION OF THE DRAWINGS

In the following, preferred embodiments of the present invention will be explained in detail making reference to the drawings enclosed, in which.

DETAILED DESCRIPTION OF THE PREFERRED EMBODIMENTS

In the following, preferred embodiments of the apparatus according to the present invention will be described in detail on the basis of FIGS. 1 to 5.

Figure 1:
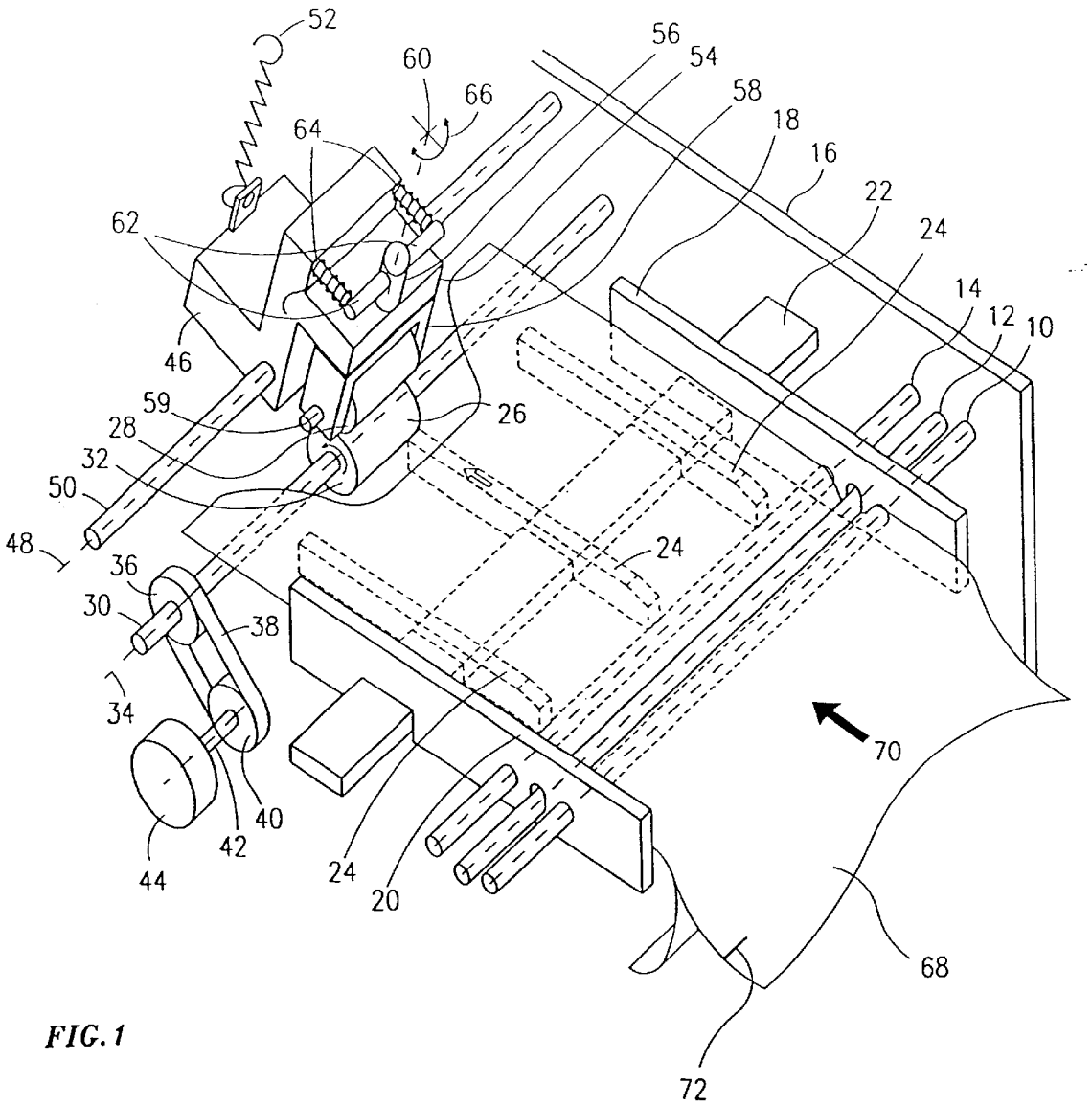
FIG. 1 shows a perspective view of an embodiment of the apparatus according to the present invention for guiding an endless paper web comprising a first transport roll arrangement.

FIG. 1 shows a first preferred embodiment of an apparatus according to the present invention used for guiding an endless paper web. A plurality of round bars 10, 12, 14 is supported between two side walls 16 (only one of these walls is, however, shown). Also two lateral guide means 18, 20 are arranged between the two side walls 16; these lateral guide means 18, 20 are mounted on a transverse strip 22 and adapted to be axially displaced relative thereto. The transverse strip 22 has additionally arranged thereon a plurality of guide strips 24.

In FIG. 1, a first 26 and a second 28 transport roll are additionally shown. The first transport roll 26 is fixed to a shaft 30 such that it is secured against rotation relative thereto; this shaft 30 is rotatable about a shaft axis 34 in a direction of rotation indicated by the arrow 32. A driving pulley 36 of the transport roll 26 is connected via a form-fit driving belt 38 to a driving pulley 40 attached to a shaft 42 of a feed motor 44.

An L-shaped bearing block 46 is axially displaceable with regard to a central axis 48 of a shaft 50, a biasing spring 52 being attached to a lower portion of the L-shaped bearing block 46. In a section 54 extending at right angles to the L-shaped bearing block 46, a shaft 56 is arranged, which is connected to a guide means 58 for the second transport roll 28, the transport roll 28 rotating about an axis 59 arranged in this guide means 58.

The shaft 56 has provided thereon two pins 62 which extend at right angles to a central axis 60 of the shaft 56, each pin 62 having a spring force applied thereto by a respective one of two springs 64. The central axis 60 extends at right angles to the axis of rotation 34 of the transport roll 26. The pivoting range of the second transport roll 28 about the central axis 60 is determined by means of the springs 64, as shown by the double arrow 66 in FIG. 1.

In FIG. 1 an endless paper web 68 is additionally shown, which runs through the apparatus for guiding an endless paper web in the direction of movement shown by the arrow 70 and which has optionally provided thereon read marks 72, if such read marks are required for further processing the endless paper web 68.

In the following, the technical mode of operation of the apparatus used for guiding an endless paper web will be described in detail making reference to FIG. 1. To simplify matters, the apparatus used for guiding an endless paper web will be referred to as paper transport means in the following.

The paper web 68 is supplied to the paper transport means from a stack, a reel or on-line from a printer (not shown). The paper web 68, which is deflected by means of at least one of the round bars 10, 12, 14, is passed in a wave shape through the round bars 10, 12, 14 which are arranged transversely to the direction of movement of the paper web 68 and which are supported between the two side walls 16 (only one of these walls is shown).

The two lateral guide means 16, 18 for the paper web 68 are secured to a transverse strip 22 and they are axially displaceable relative to said transverse strip 22. The laterally adjustable lateral guide means 18, 20 are axially adjusted such that they are spaced at a distance from one another which is only slightly larger than the paper web 68. Due to the wave-shaped path of movement through the round bars 10, 12, 14, the paper web 68 has imparted thereto a degree of stiffness which is so high that, if the paper web comes into lateral contact with the lateral guide means 18, 20, it will not be damaged and it will be prevented from ascending these lateral guide means 18, 20. One or a plurality of the round bars 10, 12, 14, i.e. in the case of three round bars preferably the central round bar 12, is/are, moreover, vertically adjustable relative to the paper web 68 in such a way that the magnitude of the paper wave amplitude can be adjusted in a range from 0 (cf. also FIG. 4) up to several millimeters, whereby the resultant stiffness of different kinds of paper can be adjusted.

A paper wave amplitude of 0 is preferably adjusted when a new endless paper web is "threaded" into the apparatus for guiding an endless paper web or when the strength of the paper web 68 running through the apparatus is already so high that no increase in strength or only a minor increase in strength is necessary for straight guidance of the paper web 68.

After a wave-shaped passage through the guide bars 10, 12, 14, the paper web 68 is supplied to the pair of transport rolls 26, 28 via the lateral guide means 18, 20 secured to a transverse strip 22. The guide strips 24 on which the paper web rests can be implemented in the form of elongate ribs, as shown in FIG. 1, paper-guiding supports or paper-supporting surfaces of an arbitrary shape being imaginable for the paper web 68.

By means of the first and second transport rolls 26, 28, a feed force is applied to the paper web 68, the first transport roll 26 being fixed to the shaft 30 such that it is secured against rotation relative thereto and driven via the form-fit driving belt 38 by means of the feed motor 44.

The second transport roll 28 is attached to the L-shaped bearing block 46 which is axially displaceable with regard to the axis 48 of the rod 50. By means of the biasing spring 52, which, as can be seen in FIG. 1, is arranged on the L-shaped bearing block 46, the second transport roll 28 is pretensioned relative to the first transport roll 26, i.e. the transport roll 28 is pressed onto the transport roll 26 with a certain spring force. The second transport roll 28 is additionally arranged such that it is rotatable about the axis of rotation 60 in the bearing block 46, the axis of rotation 60 being positioned perpendicular to and centrally to the axis 34 about which the shaft 30 rotates. By means of the two springs 64 applying a spring force to the two pins 62 which are arranged perpendicularly on the shaft 56 and parallel to the axis 59, the rotary position or pivoting range of the second transport roll 28 can be adjusted for a pendulum motion when the paper web 68 is being aligned.

The lower transport roll 26 of the transport roll arrangement consists preferably of steel and has an exact diameter so as to guarantee that deformations and temperature expansions, respectively, occurring in the case of other materials to a higher degree do not have a negative influence on a constant transport path of the paper web 68 per revolution of the drive. The upper transport roll 28 of the transport roll arrangement is provided with an elastomeric coating having a high coefficient of friction so as to avoid a possibly occurring slip between the upper transport roll 28 and the endless paper web 68.

The upper transport roll 28, which is provided with an elastomeric coating having a high coefficient of friction, is pretensioned relative to the lower transport roll 26 via the L-shaped bearing block 46 by means of the biasing spring 52. The pair of transport rolls 26, 28 is axially displaceable on the shafts 30 and 46, respectively, so that the pair of transport rolls 26, 28 can be positioned centrally to the paper web. The upper transport roll 28, which serves as a thrust roll, is additionally rotatably supported in the L-shaped bearing block 46, the axis of rotation 60 of this upper transport roll 28 extending perpendicular to and centrally to the axis of rotation 32 of the roll 26. With the aid of the adjustable compression springs 64, which act on the axis of rotation 60 via the two pins 62 on the shaft 58, the axis of movement of the roll 28 is caused to orient itself automatically parallel to the roll 26. When a paper web 68 moving at an oblique angle is adjusted by means of the lateral guide strips 18, 20 to the desired position parallel to the middle of the apparatus, i.e. to a position where the paper web 68 is oriented parallel to the lateral guide strips 18, 20, the roll 28 is additionally able to carry out the associated pendulum motion when the paper web is being aligned.

In the following, elements which are identically arranged and implemented in FIGS. 1 to 5, are designated by identical reference numerals.

Figure 2A:
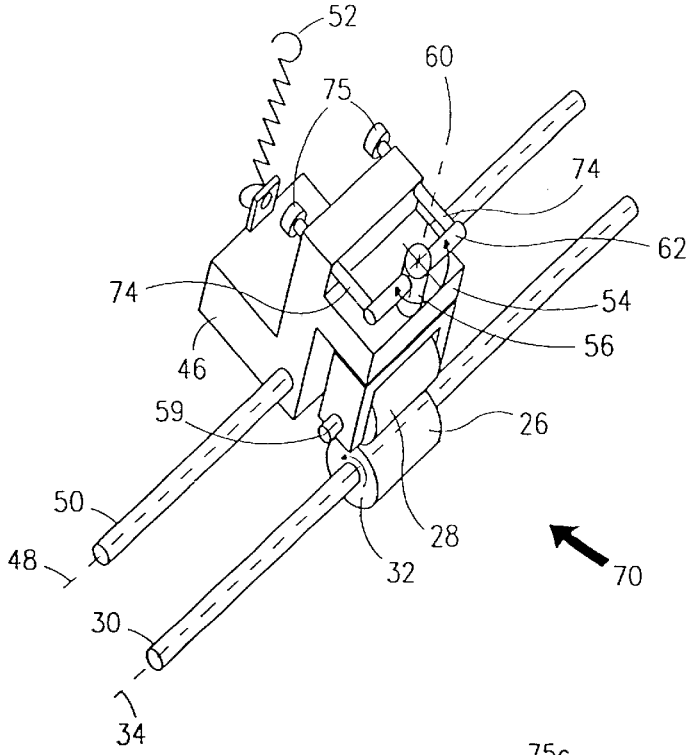
FIG. 2*a* shows a perspective view of an alternative transport roll arrangement.

FIG. 2*a* shows an alternative transport roll arrangement for adjusting the rotary position of the transport roll 28. Since in the case of very thin paper, a forced deflection of the paper web 68 is not possible, FIG. 2 shows an additional embodiment in the case of which the axis of rotation 60 of the roll 28 can be oriented precisely relative to the lateral guide means 18, 20 and secured in position via adjustable clamping screws 74, i.e. by rotating the screw heads 75. This prevents the transport roll 28 from carrying out the above-described pendulum motion by means of which a paper web 68 moving at an oblique angle is aligned parallel to the lateral guide means 18, 20, whereby a paper web consisting of a very thin and sensitive paper is prevented from being damaged, i.e. from crumpling or even tearing.

In contrast to the embodiment shown in FIG. 1 where two springs 64 are used, the adjustment of the position of the transport roll 28 relative to the axis 60, i.e. of the two pins 62 relative to the pivoting range 66 of the transport roll 28, can be accomplished by means of the two clamping screws 74. Preferably, the axis of rotation 59, about which the transport roll 28 rotates, is oriented parallel to the axis of rotation 32 of the transport roll 26. As for the rest, the mode of operation of the transport roll arrangement according to FIG. 2 is identical with that of the transport roll arrangement according to FIG. 1.

Figure 2B:
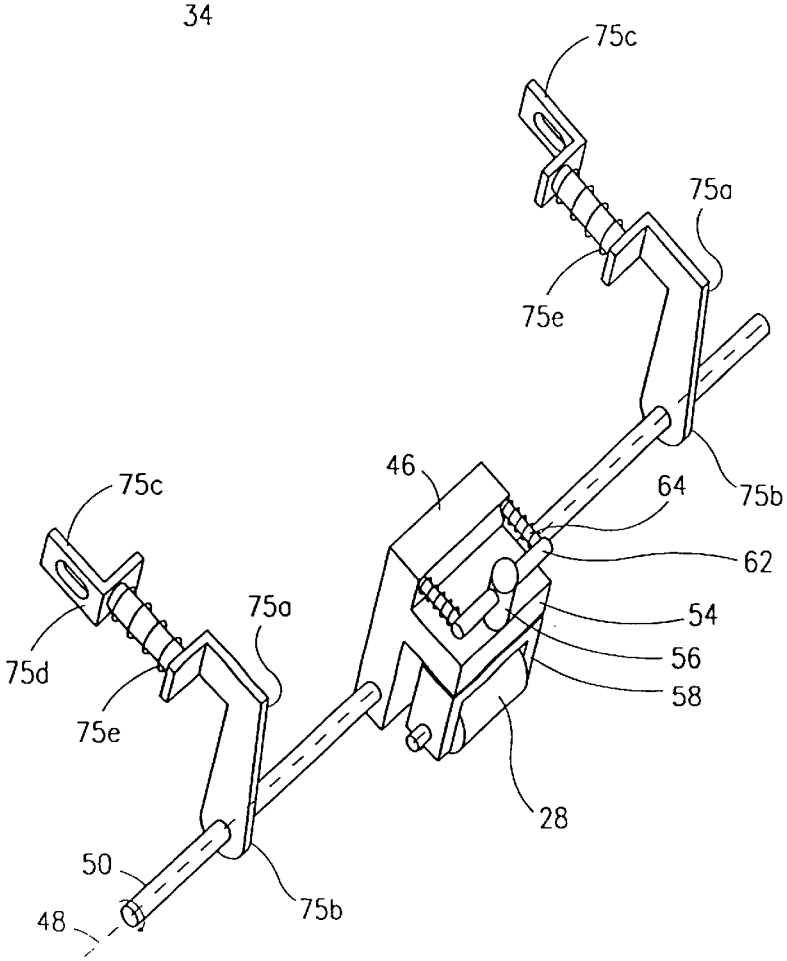
FIG. 2*b* shows a perspective view of an alternative arrangement for pretensioning a transport roll arrangement.

FIG. 2*b* shows an alternative arrangement for pretensioning the bearing block 46 and, consequently, the upper transport roll 28 relative to the lower transport roll 26.

In this embodiment the bearing block 46 is connected to the shaft 50 such that it is secured against rotation relative thereto; the bearing block 46 can additionally be axially displaceable relative to the shaft 50. In the vicinity of the two ends of the shaft 50, two connecting struts 75*a* are arranged whose lower portions 75*b* are provided with an opening for accommodating the shaft 50, the lower portions 75*b* of the connecting struts 75*a* being connected to the shaft 50 such that they are secured against rotation relative thereto. The upper portions of the connecting struts 75*a* are arranged in opposed relationship with two L-shaped stop members 75*c* provided with an opening 75*d* so that the L-shaped stop members 75*c* can be secured to a support structure (not shown). Between the opposed connecting struts 75*a* and L-shaped stop members 75*c*, a respective compression spring 75*e* is provided.

By means of these compression springs 75*e* a spring force can be applied to the upper portion of the connecting struts 75*a*, whereby a pivotal movement of the connecting strut 75*a* and, consequently, a rotation of the shaft 50 can be caused; by means of this rotation, the upper transport roll 28 arranged on the bearing block 46 is pretensioned relative to the lower transport roll 26.

Figure 3:
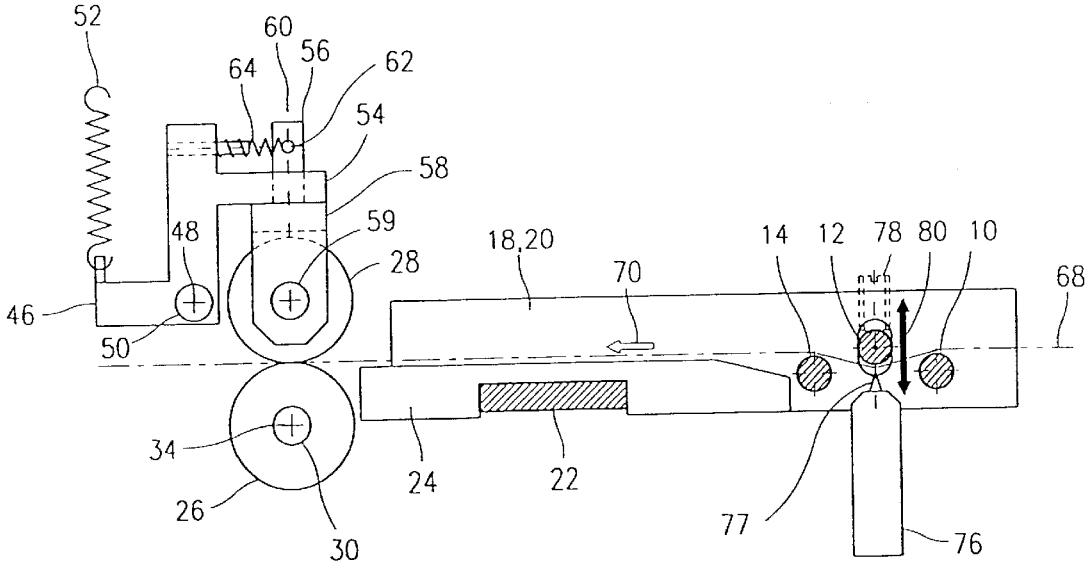
FIG. 3 shows a sectional side view of the apparatus for guiding an endless paper web provided with a mark reader.
Figure 4:
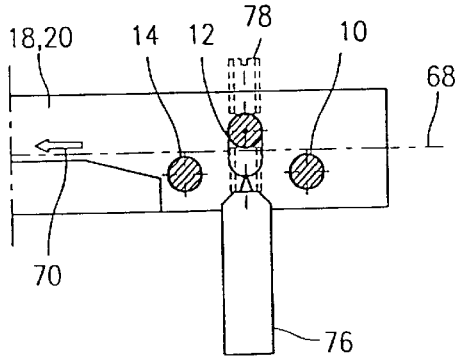
FIG. 4 shows a representation of the mark reader shown in FIG. 3.

FIGS. 3 and 4 show a paper transport means having a reader 76 arranged thereon, which is provided on the side facing the paper web 68 preferably above the adjustable round bar 12; in correspondence with the round bar 12 which is adapted to be adjusted at right angles to the direction of movement of the paper web 68, the reader 76 is adjustable by means of an adjustment device 78 relative to the direction of adjustment indicated by the double arrow 80. The reader 76 detects the marks 72 on the paper web 68 preferably with the aid of optical means 77. The adjustment device 78 is used for adjusting the vertical position of the round bar 12, and, consequently, the deflection of the paper web 68, as well as the position of the reader 76.

In FIG. 4, the position of the round bar 12 has been adjusted such that the paper web 68 is not subjected to any deflection. The different positions of the adjustable round bar 12 that can be adjusted and, consequently, the deflection of the paper web 68 are provided for the purpose of adapting the deflection of the paper web 68 to the speed at which the paper web 68 runs through the paper guide means, with due regard to the strength of the paper, the stiffness of the paper, the stressability and the thickness of the paper.

By simultaneously adjusting the vertical position 80 of the reader 76 and the adjustable round bar 12, a constant predefined distance is obtained between the paper web 68 running over the adjustable round bar 12 and the reader 76 by means of which the read marks 72 required for format length control, e.g. in paper cutting units, can be detected and read, respectively. The arrangement of the guide bars 10, 12, 14 and of the reader 76 can be adjusted such that it varies between a maximum deflection of the paper web 68 and a minimum deflection or no deflection at all of the paper web 68 (cf. FIG. 4), as has already been described above.

Figure 5:
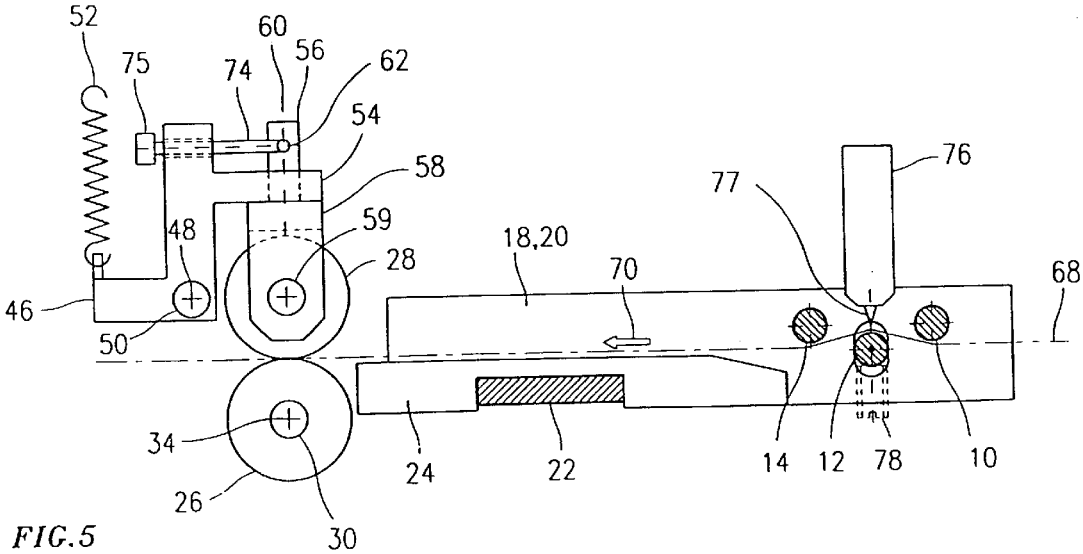
FIG. 5 shows a sectional side view of the apparatus for guiding an endless paper web with an alternative arrangement of the paper guide bars and of the mark reader.
Figure 6:
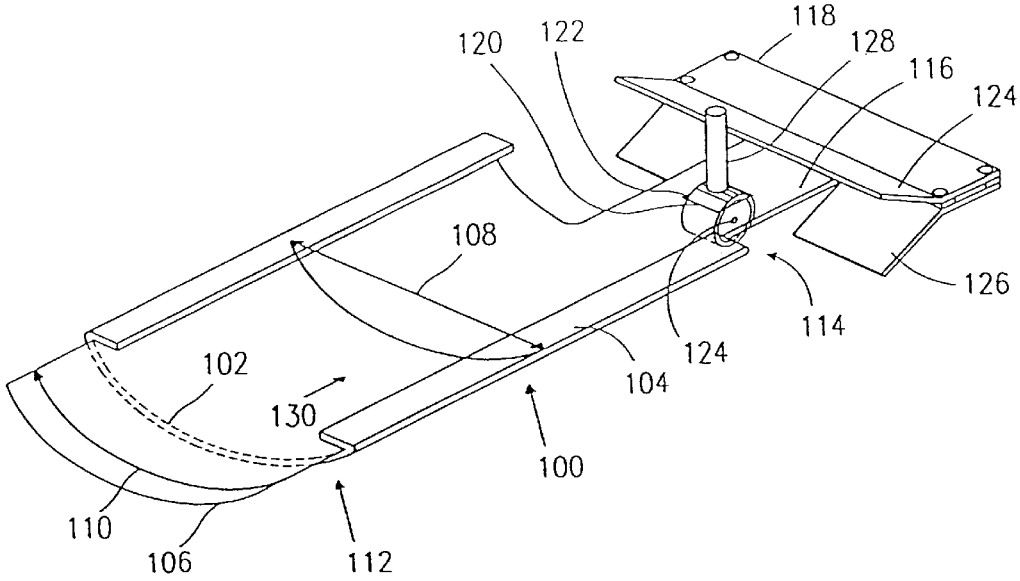
FIG.6 (Prior Art)
FIG. 6 shows a paper guide means according to the prior art.

FIG. 5 shows a sectional side view of the paper transport means with an alternative arrangement of the paper guide bars 10, 12, 14 and of the mark reader 76. FIG. 5 shows an arrangement of the reader 76 and of the adjustment device 78 relative to the direction of movement of the paper web 68 which is mirror-symmetrical with respect to the arrangement show in FIG. 4. This variant of arranging the reader 76, the adjustment device 78 and the round bars 10, 12, 14 is used when the marks 72 to be detected by the reader 76 are located on the paper web side facing the transport roll 28.

In the case of a further arrangement of the reader 76 and of the round bars 10, 12, 14, the readers 76 are arranged on both sides of the paper web on the respective side facing the paper web 68 above an arbitrary round bar 10, 12, 14, whereby the marks 72 to be detected can be provided on an arbitrary side of the paper web 68 and the reading of the read marks 72 is reliably guaranteed. The provision of the readers 76 is, however, not limited to an arrangement in which these readers 76 are necessarily arranged above the adjustable round bar 12, but they can also be located above another round bar 10, 12, 14.

When the apparatus according to the present invention is used e.g. in cutting machines requiring a very precise detection of the paper feed and of the position of the paper, respectively, it must be guaranteed that the paper web is guided as exactly as possible and that the instantaneous position of the paper web 68 is therefore detected and controlled as precisely as possible. Hence, minor slip and format length corrections are carried out by means of a correction control in the case of which the position of e.g. the cross-cutter or of some other paper processing means and the paper feed can be compared and changed, if necessary. For this kind of control, the read marks 72 are required at regular intervals on the paper web 68; during passage of the paper web 68, these read marks 72 are detected by means of the reader 76 and transmitted to an evaluation means (not shown) in which the positions of the detected read marks 72 are evaluated and further processed in a suitable manner. Making use of the detected positions of the read marks 72, the evaluations means calculates the necessary paper feed and controls the transport roll arrangement and the transport roll 26, respectively, on the basis of the detected values, whereby the feed of the endless paper web 68 is adjusted precisely and correct further processing of the endless paper web 68 is guaranteed.

In contrast to the three round bars 10, 12, 14 which are shown in the drawing and only one of which, viz. the round bar 12, is vertically adjustable in position, an arbitrary number of round bars can be provided in the apparatus for guiding an endless paper web according to the present invention; it is also possible to use a plurality of adjustable round bars so as to permit the paper web 68 to be deflected more than once. Furthermore, it is also possible to arrange a plurality of corresponding deflection arrangements, which consist of a plurality of round bars or which are implemented in accordance with the first preferred embodiment, at predefined intervals so as to permit a straight and correct guidance of an endless paper web also over distances of greater length.

In addition, the shape of the round bars provided for the deflection of the paper web 68 can be modified in comparison with the shape shown in FIG. 1 to 5. A plurality of rolls can, for example, be provided, which are arranged axially and rotatably on the round bars at regular intervals, two outer rolls being arranged such that they are flush with the lateral guide means and the lateral guide strips, respectively, so that the edges of the paper web 68 extend perpendicularly to the lateral guide means, i.e. so that these edges only move perpendicularly into contact with the lateral guide means. This has the effect that the size of the contact surface on which the endless paper web 68 moves over the respective rolls is reduced.

Furthermore, the reader 76 can be arranged at a location other than the position above a round bar, e.g. the adjustable round bar; it must, however, be guaranteed that the distance between the paper web 68 and the respective reader 76 is kept constant so as to guarantee that the read marks 72 arranged on the paper web 68 are read precisely and without errors.

What is claimed is:

1. An apparatus for guiding an endless paper web having longitudinal edges and a direction of movement, comprising two lateral guide devices guiding the endless paper web at the longitudinal edges of the endless paper web;

a deflector with the aid of which the endless paper web is deflected at least once from the direction of movement of the endless paper web while the endless paper web is moving between the lateral guide devices; and a first transport roll on a drivable shaft and a second transport roll for applying a feed force to the endless paper web passing between the first and the second transport roll.

2. The apparatus according to claim 1, wherein the endless paper web passes in a wave shape through the deflector of the endless paper web.

3. The apparatus according to claim 1, wherein the deflector of the endless paper web comprises a plurality of round bars.

4. The apparatus according to claim 3, wherein the deflector of the endless paper web is composed of three round bars, at least one of the round bars being adapted to be deflected at right angles to the direction of movement of the endless paper web so as to guide the endless paper web in a wave shape between the round bars in the direction of movement.

5. The apparatus according to claim 1, wherein the two lateral guide devices for the endless paper web are implemented in the form of two guide strips arranged in parallel in the direction of movement of the endless paper web, the distance between two parallel guide strips being axially adjustable.

6. The apparatus according to claim 1, wherein the second transport roll is pretensioned relative to the first transport roll by means of a spring.

7. The apparatus according to claim 1, wherein the second transport roll is arranged such that it is rotatable relative to the first transport roll about an axis of rotation extending essentially at right angles to the drive shaft of the first transport roll.

8. The apparatus according to claim 7, wherein a rotary movement about the axis of rotation is limited by springs.

9. The apparatus according to claim 1, wherein the second transport roll is arranged such that it is displaced relative to the first transport roll about an axis of rotation extending essentially at right angles to the drive shaft of the first transport roll.

10. The apparatus according to claim 9, wherein the position of rotary displacement of the second transport roll relative to the first transport roll can be adjusted by means of screws.

11. The apparatus according to claim 1, wherein the first transport roll consists of steel and the second transport roll is provided with an elastomeric coating.

12. The apparatus according to claim 1, wherein a reader is provided for reading marks arranged on the endless paper web.

13. The apparatus according to claim 12, wherein the reader is provided on the side facing the endless paper web above the adjustable round bar of the plurality of round bars and is adapted to be adjusted in accordance with the round bar, which is adjustable at right angles to the direction of movement of the endless paper web so as to guarantee a predefined constant distance between the reader and the endless paper web.

* * * * *